US010411424B2

(12) United States Patent
Lin

(10) Patent No.: US 10,411,424 B2
(45) Date of Patent: Sep. 10, 2019

(54) CONDUCTIVE BUILDING BLOCK HAVING MULTI-SIDED CONDUCTIVITY

(71) Applicant: LONGMEN GETMORE POLYURETHANE CO., LTD., Huizhou (CN)

(72) Inventor: Chia-Yen Lin, Huizhou (CN)

(73) Assignee: LONGMEN GETMORE POLYURETHANE CO., LTD., Huizhou (CN)

( * ) Notice: Subject to any disclaimer, the term of this patent is extended or adjusted under 35 U.S.C. 154(b) by 0 days.

(21) Appl. No.: 15/975,804

(22) Filed: May 10, 2018

(65) Prior Publication Data

US 2019/0165527 A1 May 30, 2019

(30) Foreign Application Priority Data

Nov. 29, 2017 (CN) ..... 2017 1 1226595

(51) Int. Cl.

| | |
|---|---|
| ***A63H 33/08*** | (2006.01) |
| ***A63H 33/04*** | (2006.01) |
| ***H01R 31/02*** | (2006.01) |
| ***H01R 13/24*** | (2006.01) |

(52) U.S. Cl.

CPC ..... *H01R 31/02* (2013.01); *A63H 33/042* (2013.01); *A63H 33/086* (2013.01); *H01R 13/2428* (2013.01)

(58) Field of Classification Search

CPC ..... A63H 33/04; A63H 33/042; A63H 33/08; A63H 33/086; H01R 13/2428

See application file for complete search history.

(56) References Cited

U.S. PATENT DOCUMENTS 4,715,832 A * 12/1987 Bach ..... H01R 9/2408 439/715
8,651,913 B1 * 2/2014 Lin ..... A63H 33/042 446/91
8,764,507 B2 * 7/2014 Lin ..... A63H 33/042 446/91

(Continued)

*Primary Examiner* — Eugene L Kim
*Assistant Examiner* — Alyssa M Hylinski
(74) *Attorney, Agent, or Firm* — Lin & Associates Intellectual Property, Inc.

(57) ABSTRACT

A conductive building block having multi-sided conductivity includes a first stud disposed on a top side surface of an outer housing; a second stud disposed on a lateral side surface of the outer housing; and an engaging recess disposed on a bottom side surface of the outer housing. A circuit board, first positive-and-negative electrode connection pieces and second positive-and-negative electrode connection pieces are received in the outer housing. An illuminating member is mounted on the circuit board. The first positive-and-negative electrode connection piece is electrically connected with the circuit board and passes through the first stud. The second positive-and-negative electrode connection piece is electrically connected with the first positive-and-negative electrode connection piece and passes through the second stud. The conductive building blocks can form the longitudinal connection structure or the lateral connection structure, so that the connection ways of the conductive building blocks can be diversified.

3 Claims, 8 Drawing Sheets

(56) References Cited

U.S. PATENT DOCUMENTS

| | | | | |
|---|---|---|---|---|
| 9,016,902 | B1 * | 4/2015 | Lin | F21S 2/005 362/249.01 |
| 9,457,287 | B1 * | 10/2016 | Lin | A63H 33/042 |
| 9,841,180 | B1 * | 12/2017 | Lin | F21V 15/01 |
| 2007/0184722 | A1 * | 8/2007 | Doherty | A63H 33/042 439/638 |
| 2009/0047863 | A1 * | 2/2009 | Capriola | A63H 33/042 446/91 |
| 2012/0181917 | A1 * | 7/2012 | Lin | A63H 33/042 313/318.12 |
| 2012/0218211 | A1 * | 8/2012 | McRae | G06F 1/1656 345/173 |
| 2013/0109268 | A1 * | 5/2013 | Lin | A63H 33/042 446/91 |
| 2015/0072585 | A1 * | 3/2015 | Lin | A63H 33/042 446/91 |

* cited by examiner

CONDUCTIVE BUILDING BLOCK HAVING MULTI-SIDED CONDUCTIVITY

CROSS-REFERENCE TO RELATED APPLICATION

This application claims the priority of Chinese patent application No. 201711226595.2, filed on Nov. 29, 2017, which is incorporated herewith by reference.

BACKGROUND OF THE INVENTION

1. Field of the Invention

The present invention relates generally to a conductive building block, and more particularly to a conductive building block capable of connecting and forming electric connection at multiple sides.

2. The Prior Arts

Because the building blocks can be connected in various ways and a wide variety of designs can be formed by making the building blocks engaged with each other, they are popular all around the world. In addition to different designs provided by various connection ways, some of the building blocks available in the market even include circuits and illuminating members, which can provide more eye-catching visual effects by illuminating various colors of light. However, the conventional building blocks can only be connected up and down in a single direction to form the engagement structure, and can not provide connection in the lateral direction. In other words, if trying to connect the building blocks to form a horizontally extended structure, it needs to make the building blocks engaged with each other by position alternating engagement. Therefore, the engagement structure is not secure and the connection ways of the building blocks are limited.

Therefore, the present invention proposes an improvement scheme to overcome the disadvantages of the conventional conductive building blocks.

SUMMARY OF THE INVENTION

A primary objective of the present invention is to provide a conductive building block having multi-sided conductivity, which can be connected in the longitudinal direction or in the lateral direction. Moreover, the electric connection can be formed between the longitudinally connected or laterally connected conductive building blocks.

In order to achieve the foregoing objective, a conductive building block having multi-sided conductivity according to the present invention comprises: an outer housing being a hollow member and including: at least one first stud disposed on a top side surface of the outer housing, the first stud formed with at least one through hole; at least one second stud disposed on a lateral side surface of the outer housing, the second stud formed with at least one through hole; and at least one engaging recess disposed on a bottom side surface of the outer housing; a circuit board disposed in the outer housing and including: a positive-and-negative electrode circuit disposed on the circuit board and corresponding to the at least one engaging recesses; and a plurality of electric connection elements disposed in the outer housing and electrically connected with the circuit board, each electric connection element passing through the through hole of the first stud or the second stud.

Therefore, the advantages of the present invention include that the conductive building blocks having multi-sided conductivity can form the longitudinal connection structure or the lateral connection structure. No matter how the conductive building blocks are connected in the longitudinal direction or in the lateral direction, the connected conductive building blocks can form the electric connection. Therefore, the conductive building blocks can be connected in series and the illuminating members in the connected building blocks can be electrically connected. Thus, the connection ways of the conductive building blocks having multi-sided conductivity according to the present invention can be diversified to create more connection designs and the illumination of the conductive building blocks can provide the exceptional visual effects.

In the conductive building block having multi-sided conductivity as mentioned above, each of the electric connection elements includes at least one first positive-and-negative electrode connection piece disposed in the outer housing, and the first positive-and-negative electrode connection piece includes one end electrically connected with the circuit board and another end passing through the through hole of the first stud.

In the conductive building block having multi-sided conductivity as mentioned above, each of the electric connection elements includes at least one second positive-and-negative electrode connection piece disposed in the outer housing, and the second positive-and-negative electrode connection piece includes one end electrically connected with the first positive-and-negative electrode connection piece and another end passing through the through hole of the second stud.

In the conductive building block having multi-sided conductivity as mentioned above, the second positive-and-negative electrode connection piece includes: an elastic piece portion having one end electrically connected with the first positive-and-negative electrode connection piece and another end passing through the through hole of the second stud; and two abutting portions respectively disposed at both sides of the elastic piece portion and abutted against side walls of the through hole of the second stud.

In the conductive building block having multi-sided conductivity as mentioned above, each abutting portion is shaped in an elongated strip and is provided with a first end and a second end opposite to each other and an exterior side edge extended along a longitudinal direction thereof, a section where the abutting portions are connected with the elastic piece portion is adjacent to the first ends of the abutting portions, and the exterior side edges of the abutting portions are abutted against the side walls of the through hole of the second stud.

In the conductive building block having multi-sided conductivity as mentioned above, the first positive-and-negative electrode connection piece includes a concave portion corresponding to the through hole of the second stud, each abutting portion includes a first protrusion disposed at an end of the abutting portion and projected in a direction away from the elastic piece portion, and the abutting portions are abutted against side walls of the concave portion of the first positive-and-negative electrode connection piece.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
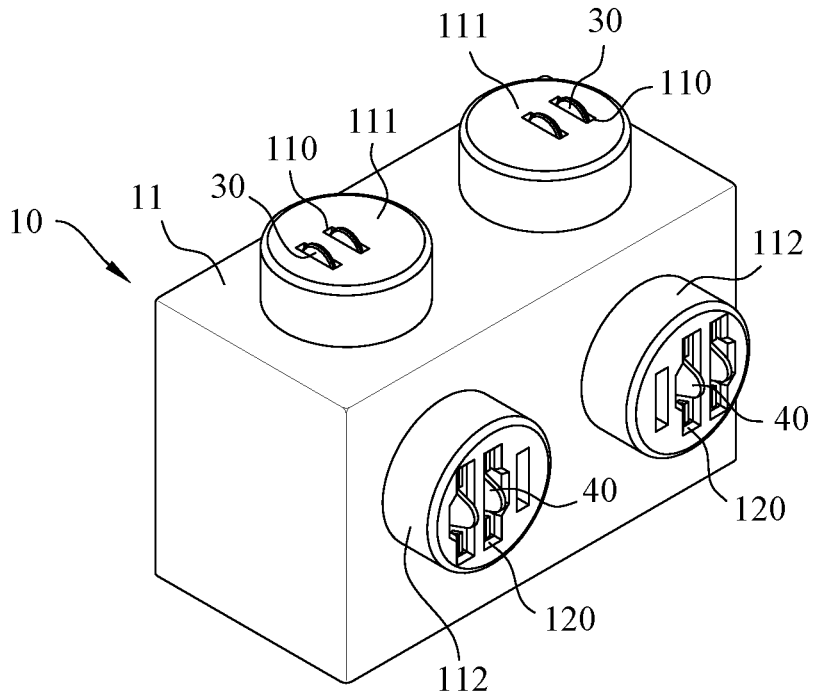
FIG. 1 is a perspective view showing a conductive building block having multi-sided conductivity according to the present invention.

The accompanying drawings are included to provide a further understanding of the invention, and are incorporated in and constitute a part of this specification. The drawings illustrate preferred embodiments of the invention and, together with the description, serve to explain the principles of the invention. Like reference numerals designate like elements in the accompanying drawings.

Figure 2:
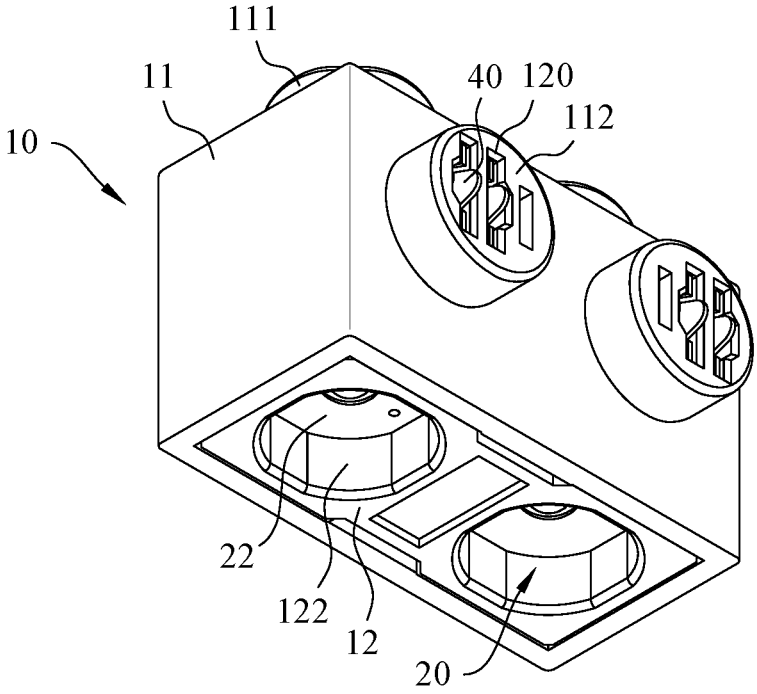
FIG. 2 is a perspective view showing the conductive building block having multi-sided conductivity according to the present invention in another viewing angle.
Figure 3:
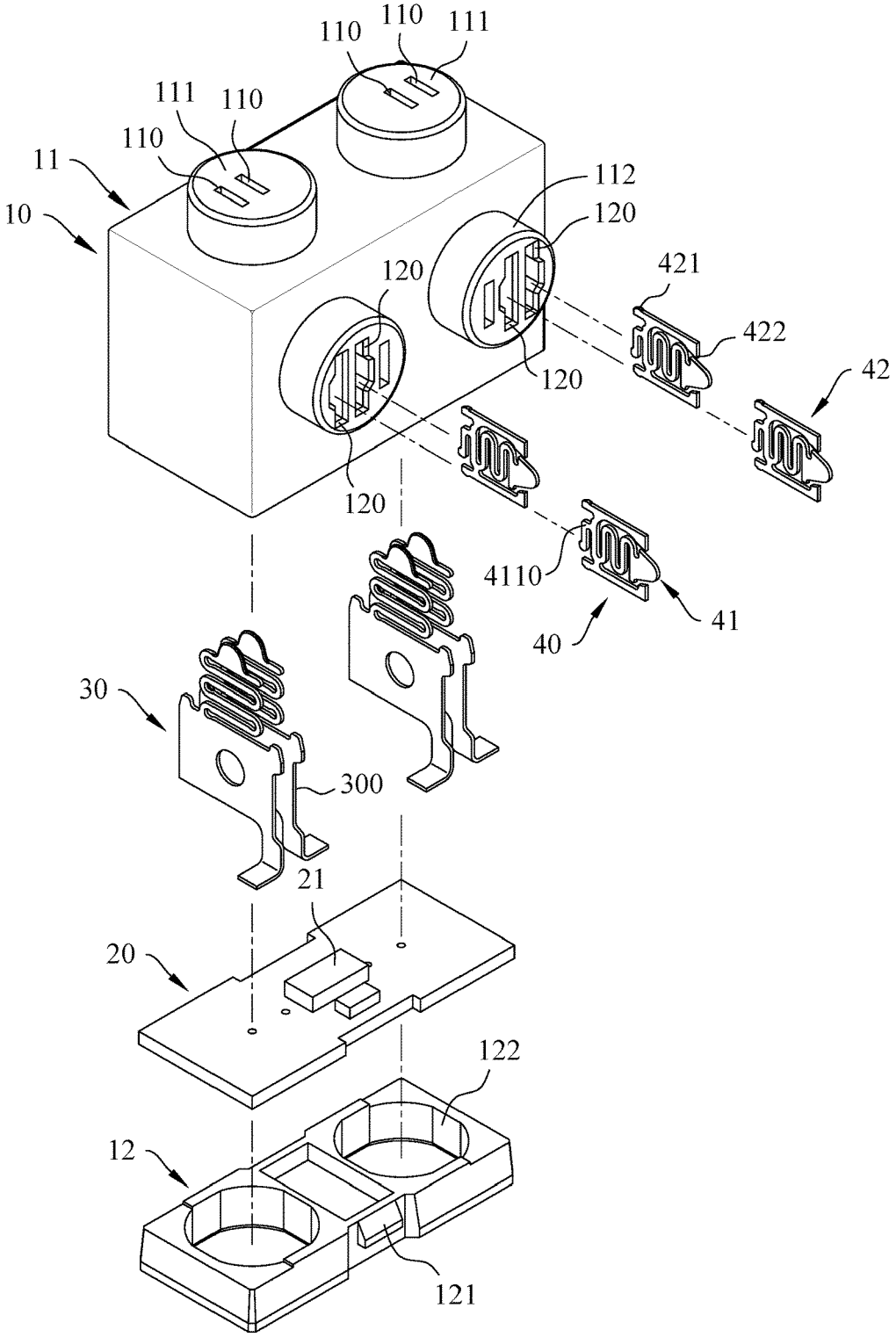
FIG. 3 is an exploded view showing the conductive building block having multi-sided conductivity according to the present invention.

With reference to the drawings and in particular to FIGS. 1 to 3, a conductive building block having multi-sided conductivity according to the present invention includes an outer housing 10, a circuit board 20, a plurality of electric connection elements. The circuit board 20 and the electric connection elements are disposed in the outer housing 10.

Figure 7:
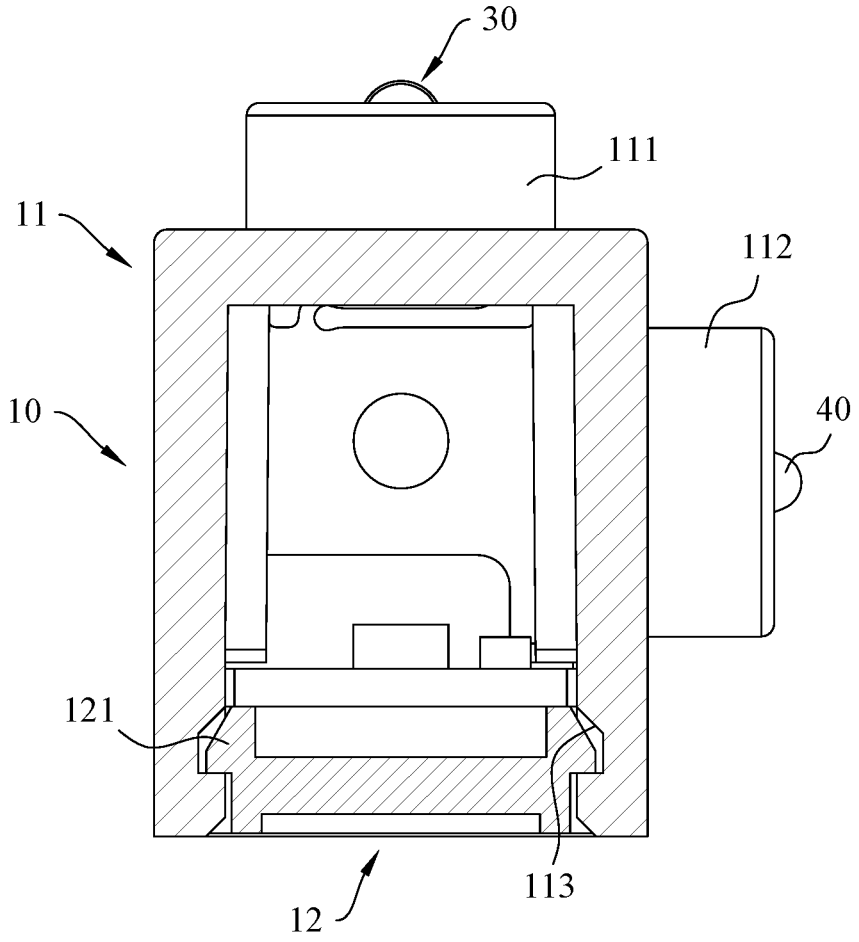
FIG. 7 is a cross-sectional view taken along line VII-VII in FIG. 5.

The outer housing 10 includes a top cover 11 and a bottom seat 12. The top cover 11 is hollow and is formed with an inner space and a bottom opening. The bottom opening is communicated with the inner space. The top cover 11 includes at least one first stud 111 and at least one second stud 112. The at least one first stud 111 is disposed on the top side surface of the exterior of the top cover 11. Each first stud 111 is formed with a plurality of through holes 110. The at least one second stud 112 is disposed on the lateral side surface of the exterior of the top cover 11. Each second stud 112 is formed with a plurality of through holes 120. The inner side edges of the bottom opening of the top cover 11 are formed with a plurality of grooves 113 as shown in FIG. 7. According to the present preferred embodiment, only one lateral side surface is formed with the second studs 112, but is not limited thereto. It may be a plurality of lateral side surfaces formed with the second studs 112.

Referring to FIGS. 3 and 7, the bottom seat 12 is fixed at the bottom opening of the top cover 11 and is formed with a plurality of projected ribs 121 and at least one engaging recess 122. The projected ribs 121 of the bottom seat 12 are engaged with the grooves 113 at the inner side edges of the bottom opening of the top cover 11, respectively, so as to mount the base 12 to the top cover 11. Each of the engaging recesses 122 can be engaged with the first stud 111 or the second stud 112 of another conductive building block so as to form the electric connection between the engaged conductive building blocks. Therefore, the engaging recesses 122 of the bottom seat 12 of one conductive building block can be engaged with the first studs 111 of the top side surface of the top cover 11 of another conductive building block having multi-sided conductivity to form the longitudinal connection structure, and can also be engaged with the second studs 112 of the lateral side surface of the top cover 11 of another conductive building block having multi-sided conductivity to form the lateral connection structure. Thus, the conductive building blocks having multi-sided conductivity according to the present invention have more diversified connection ways than the conventional conductive building blocks and can be connected to form more diverse connection designs.

Then, referring to FIGS. 2, 3, 5 and 6, the circuit board 20 is received in the inner space of the top cover 11. According to the present preferred embodiment, the circuit board 20 is positioned in the inner space of the outer housing 10 by pressing the bottom seat 12 against the circuit board 20. The circuit board 20 includes an illuminating member 21 and a positive-and-negative electrode circuit 22. The illuminating member 21 is mounted on a top side of the circuit board 20, and the positive-and-negative electrode circuit 22 is provided on a bottom side of the circuit board 20 and faces the engaging recesses 122 of the bottom seat 12.

The electric connection elements are provided in the inner space of the top cover 11 and electrically connected with the circuit board 20. Each of the electric connection elements passes through the through holes 110 of the first studs 111 and the through holes 120 of the second studs 112, respectively. In particular, each electric connection element includes two first positive-and-negative electrode connection pieces 30 and two second positive-and-negative electrode connection pieces 40.

Figure 8:
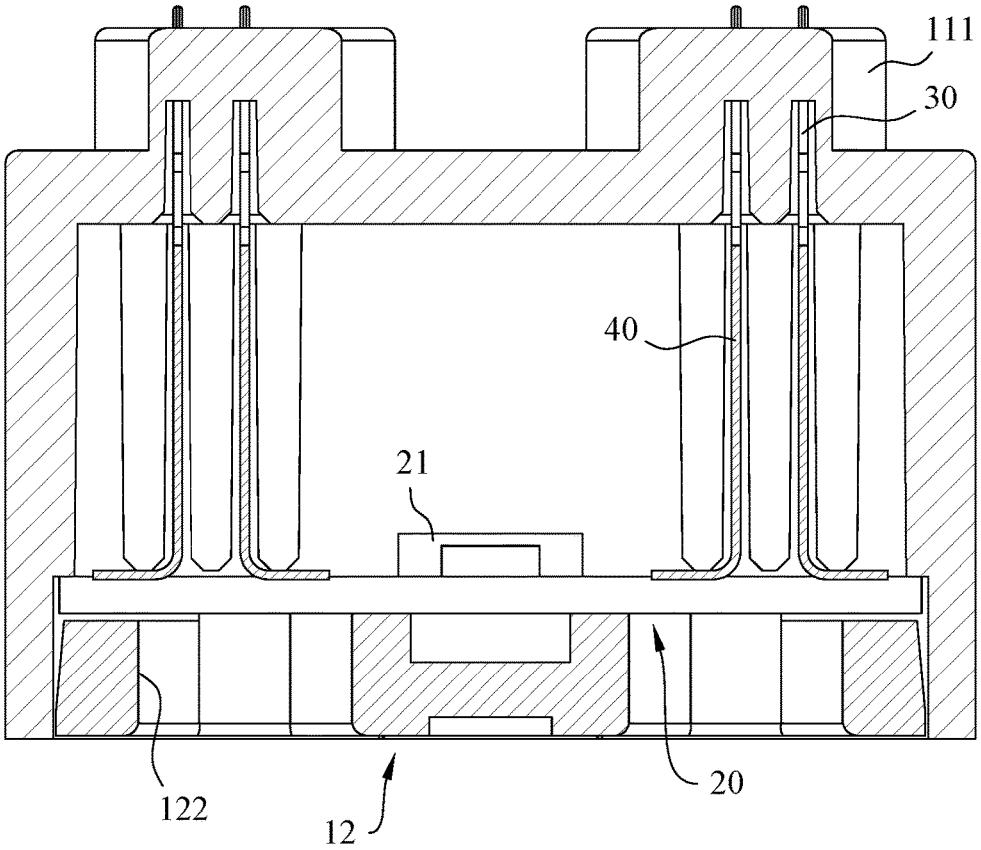
FIG. 8 is a cross-sectional view taken along line VIII-VIII in FIG. 5.

The first positive-and-negative electrode connection pieces 30 are provided in the inner space of the top cover 11. As shown in FIG. 8, each of the first positive-and-negative electrode connection pieces 30 has one end electrically connected with the circuit board 20 and another end passing through the through hole 110 of the first stud 111. Each of the first positive-and-negative electrode connection pieces 30 includes a concave portion 300 corresponding to the through hole 120 of the second stud 112. According to another preferred embodiment, the first positive-and-negative electrode connection piece 30 may also pass through the through hole 120 of the second stud 112, and the concave portion 300 faces the through hole 110 of the first stud 111.

Figure 4:
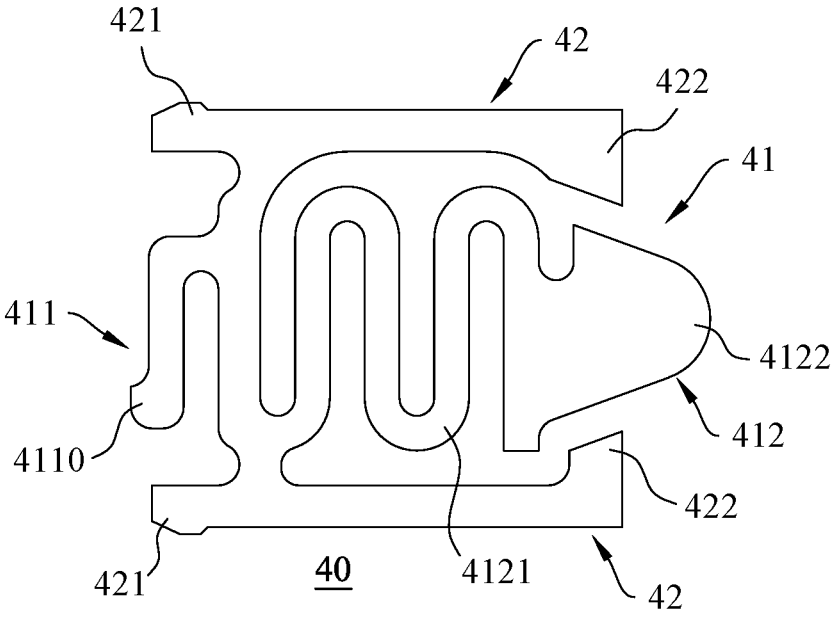
FIG. 4 is an enlarged view showing a second positive-and-negative electrode connection piece according to the present invention.
Figure 5:
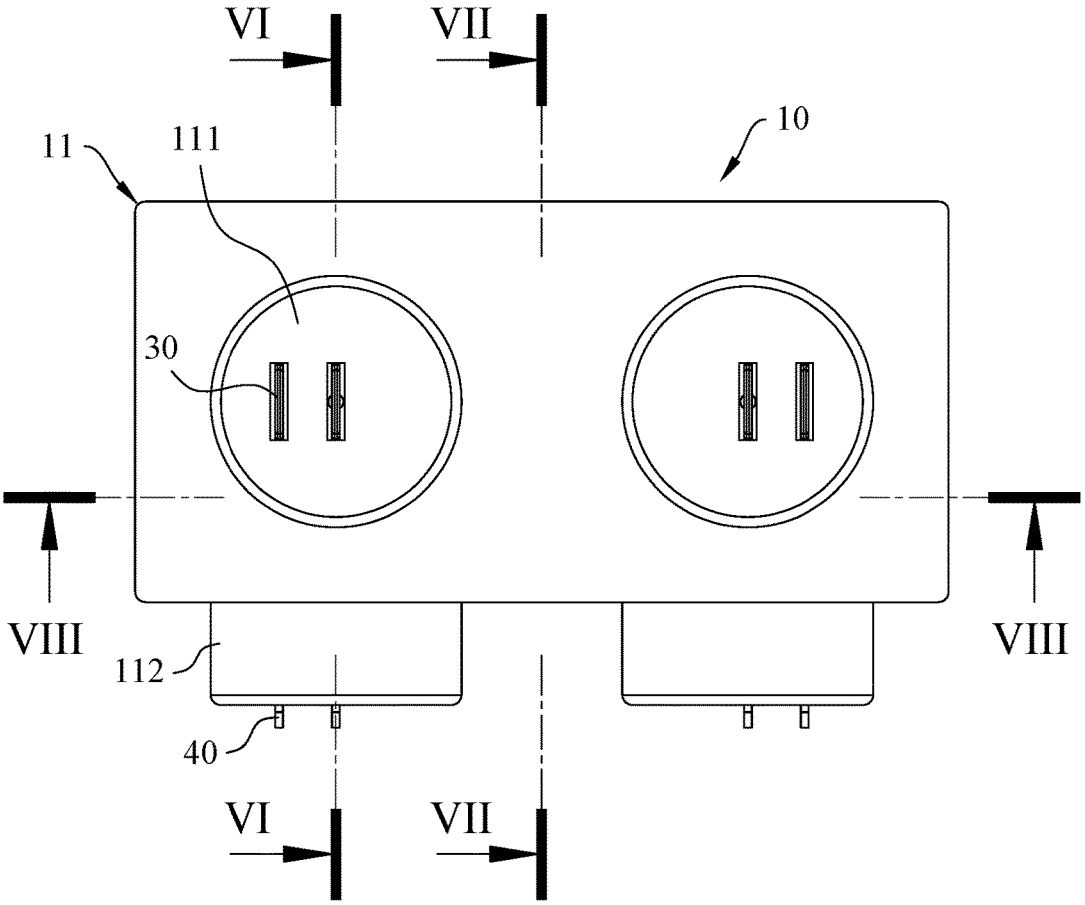
FIG. 5 is a top view showing the conductive building block having multi-sided conductivity according to the present invention.
Figure 6:
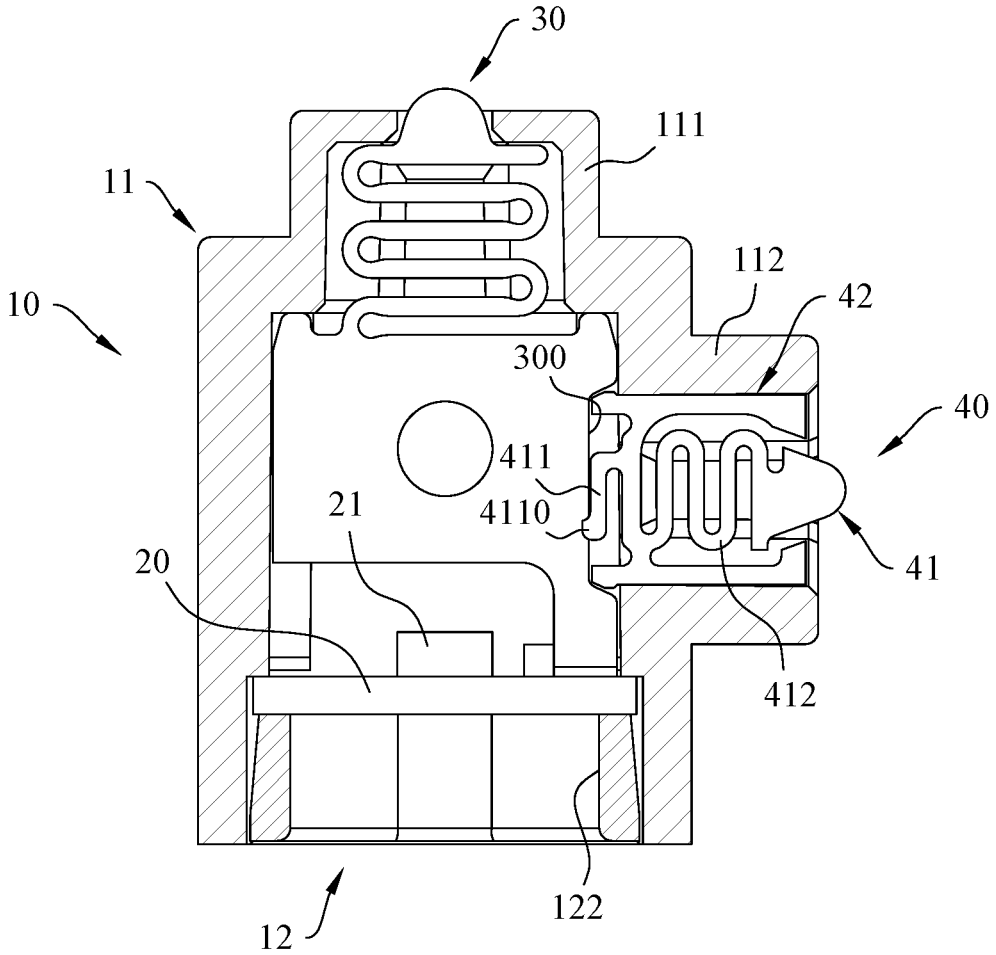
FIG. 6 is a cross-sectional view taken along line VI-VI in FIG. 5.

With reference to FIGS. 3, 4 and 6, the second positive-and-negative electrode connection pieces 40 are provided in the inner space of the top cover 11. Each of the second positive-and-negative electrode connection pieces 40 has one end to be electrically connected with the first positive-and-negative electrode connection pieces 30 and another end passing through the through hole 120 of the second stud 112. According to the present preferred embodiment, each of the second positive-and-negative electrode connection pieces 40 includes an elastic piece portion 41 and two abutting portions 42. Both ends of the elastic piece portion 41 include a first elastic end 411 and a second elastic end 412, respectively. The first elastic end 411 is received in the concave portion 300 of the first positive-and-negative electrode connection pieces 30 and electrically connected with the first positive-and-negative electrode connection pieces 30. The first elastic end 411 is shaped in an elongated strip. The elongated-strip-shaped first elastic end 411 includes one end connected with the second elastic end 412 and another end having a projected portion 4110. The projected portion 4110 is projected toward the first positive-and-negative electrode connection pieces 30. The first elastic end 411 can provide an elastic force due to the deformation of a connection section of the first elastic end 411 and the second elastic end 412, so as to abut the projected portion 4110 against the first positive-and-negative electrode connection pieces 30.

The second elastic end 412 of the elastic piece portion 41 is located at an end opposite to the first elastic end 411. The second elastic end 412 passes through the corresponding through hole 120 of the second stud 112. The second elastic end 412 includes a wavy section 4121 and a projected section 4122. The projected section 4122 is disposed at an end of the wavy section 4121 and passes through the corresponding through hole 120 of the second stud 112. According to the present preferred embodiment, the wavy section 4121 of the second elastic end 412 is connected with the first elastic end 411 at an end opposite to the projected section 4122.

The abutting portions 42 are respectively disposed at two sides of the elastic piece portion 41, and are connected with a section where the first elastic end 411 is connected with the second elastic end 412. The abutting portions 42 are abutted against the side walls of the through hole 120 of the corresponding second stud 112, respectively. Each abutting portion 42 is shaped in an elongated strip and is provided with a first end and a second end opposite to each other and an exterior side edge extended along a longitudinal direction thereof. A section where the abutting portions 42 is connected with the elastic piece portion 41 is adjacent to the first end of the abutting portions 42. Moreover, the exterior side edges of the abutting portions 42 are abutted against the side walls of the through hole 120 of the corresponding second stud 112. According to the present preferred embodiment, each of the abutting portions 42 includes a first protrusion 421 and a second protrusion 422. The first protrusion 421 is disposed at the first end of the abutting portion 42 and is projected in a direction away from the elastic piece portion 41. The first protrusions 421 of the abutting portions 42 are abutted against the side walls of concave portion 300 of the corresponding first positive-and-negative electrode connection pieces 30. The second protrusion 422 is disposed at the second end of the abutting portion 42 and is projected toward the elastic piece portion 41.

With reference to FIG. 3, when assembling the conductive building block having multi-sided conductivity according to the present invention, first of all, the first positive-and-negative electrode connection pieces 30 are mounted on the circuit board 20 to form the electric connection. Then, the circuit board 20 and the first positive-and-negative electrode connection pieces 30 are put into the top cover 11, so that the ends of the first positive-and-negative electrode connection pieces 30 pass through the through holes 110 of the first studs 111 of the top cover 11. At last, the bottom seat 12 is connected with the bottom opening of the top cover 11. When the bottom seat 12 is connected with the top cover 11, the bottom seat 12 is abutted against the circuit board 20, so that the first positive-and-negative electrode connection pieces 30 are abutted against an inner side surface of the top cover 11. Therefore, the first positive-and-negative electrode connection pieces 30 can be fixed.

Secondly, referring to FIGS. 3 and 4, the second positive-and-negative electrode connection pieces 40 are inserted into the through holes 120 of the second studs 112. Because the concave portion 300 of the first positive-and-negative electrode connection piece 30 faces one of the through holes 120 of the second stud 112, the projected portion 4110 on the first elastic end 411 of the second positive-and-negative electrode connection piece 40 can be abutted against the concave portion 300 of the first positive-and-negative electrode connection piece 30 and the first protrusions 421 of the abutting portions 42 are abutted against the side walls of the concave portion 300 after the insertion of the second positive-and-negative electrode connection pieces 40. Therefore, the second positive-and-negative electrode connection piece 40 is connected with the first positive-and-negative electrode connection pieces 30 to form the electric connection. In the mean time, the abutting portions 42 of the second positive-and-negative electrode connection pieces 40 are abutted against the side walls of the through holes 120 of the second stud 112, and a friction force is generated between the abutting portions 42 and the through holes 120 of the second stud 112 because the abutting portions 42 applies an elastic force upon the side walls of the through hole 120. Moreover, referring to FIGS. 4 and 6, the hook-shaped first protrusions 421 of the abutting portions 42 of the second positive-and-negative electrode connection pieces 40 would interfere with the bottom of the second stud 112 after the second positive-and-negative electrode connection pieces 40 is inserted into the second stud 112. Thus, the second positive-and-negative electrode connection piece 40 can not be slipped away from the through hole 120 of the second stud 112. At this moment, the second elastic end 412 of the elastic piece portion 41 of the second positive-and-negative electrode connection pieces 40 is projected out of the through hole 120 of the corresponding second stud 112. Therefore, the position of the second positive-and-negative electrode connection pieces 40 can be fixed.

According to the structure mentioned above, no matter forming the longitudinal connection structure or the lateral connection structure, the bottom seat 12 of one conductive building block can be engaged with the first studs 111 or the second stud 112 of another conductive building block, so that the connected conductive building blocks can form the electric connection and the electricity can be conducted between the connected conductive building blocks.

In summary, the conductive building blocks having multi-sided conductivity according to the present invention can form the longitudinal connection structure or the lateral connection structure. No matter the conductive building blocks are connected in the longitudinal direction or in the lateral direction, the connected conductive building blocks can form the electric connection. Therefore, the conductive building blocks can be connected in series and the illuminating members 21 in the connected building blocks can be electrically connected. Thus, the connection ways of the conductive building blocks having multi-sided conductivity according to the present invention can be diversified to create more connection designs and the illumination of the conductive building blocks can provide the exceptional visual effects.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A conductive building block having multi-sided conductivity, comprising:

an outer housing being a hollow member and including:

at least one first stud disposed on a top side surface of the outer housing, the first stud formed with at least one through hole;

at least one second stud disposed on a lateral side surface of the outer housing, the second stud formed with at least one through hole; and at least one engaging recess disposed on a bottom side surface of the outer housing;

a circuit board disposed in the outer housing and including:

a positive-and-negative electrode circuit disposed on the circuit board and corresponding to the at least one engaging recess; and a plurality of electric connection elements disposed in the outer housing and electrically connected with the circuit board;

wherein each of the electric connection elements includes:

at least one first positive-and-negative electrode connection piece being disposed in the outer housing and having one end electrically connected with the circuit board and another end passing through the through hole of the first stud; and at least one second positive-and-negative electrode connection piece being disposed in the outer housing and having an elastic piece portion with one end of the elastic piece portion being electrically connected with the first positive-and-negative electrode connection piece and another end of the elastic piece portion passing through the through hole of the second stud, and two abutting portions respectively disposed at both sides of the elastic piece portion and abutted against side walls of the through hole of the second stud.

2. The conductive building block having multi-sided conductivity according to claim 1, wherein each abutting portion is shaped in an elongated strip and is provided with a first end and a second end opposite to each other and an exterior side edge extended along a longitudinal direction thereof, a section where the abutting portions are connected with the elastic piece portion is adjacent to the first ends of the abutting portions, and the exterior side edges of the abutting portions are abutted against the side walls of the through hole of the second stud.

3. The conductive building block having multi-sided conductivity according to claim 1, wherein the first positive-and-negative electrode connection piece includes a concave portion corresponding to the through hole of the second stud, and each abutting portion includes a first protrusion disposed at an end of the abutting portion and projected in a direction away from the elastic piece portion, and the abutting portions are abutted against side walls of the concave portion of the first positive-and-negative electrode connection piece.

* * * * *